US008998074B2

(12) United States Patent
Schomisch

(10) Patent No.: US 8,998,074 B2
(45) Date of Patent: Apr. 7, 2015

(54) DISPLAYABLE SHIPPING CONTAINER

(71) Applicant: Packaging Corporation of America, Lake Forest, IL (US)

(72) Inventor: Joseph P. Schomisch, Burlington, WI (US)

(73) Assignee: Packaging Corporation of America, Lake Forest, IL (US)

( * ) Notice: Subject to any disclaimer, the term of this patent is extended or adjusted under 35 U.S.C. 154(b) by 156 days.

(21) Appl. No.: 13/750,898

(22) Filed: Jan. 25, 2013

(65) Prior Publication Data

US 2013/0206828 A1 Aug. 15, 2013

Related U.S. Application Data

(60) Provisional application No. 61/596,910, filed on Feb. 9, 2012.

(51) Int. Cl.
*B65D 5/54* (2006.01)
*B65D 5/32* (2006.01)
*B65D 5/16* (2006.01)

(52) U.S. Cl.
CPC *B65D 5/32* (2013.01); *B65D 5/545* (2013.01); *B65D 5/16* (2013.01); *B65D 5/326* (2013.01); *B65D 5/541* (2013.01); *Y10S 229/918* (2013.01)

(58) Field of Classification Search
USPC ..... 229/122.32, 240, 241, 242, 915, 918; 206/736, 772, 773, 774
See application file for complete search history.

(56) References Cited

U.S. PATENT DOCUMENTS

| | | | | |
|---|---|---|---|---|
| 5,277,360 | A | 1/1994 | DeMott | 229/122 |
| 5,555,982 | A * | 9/1996 | Kuhn et al. | 206/772 |
| 5,657,872 | A * | 8/1997 | Leftwich et al. | 229/240 |
| 5,950,914 | A * | 9/1999 | Dunton et al. | 229/240 |
| 5,957,294 | A | 9/1999 | Kanter | 206/774 |
| 6,189,780 | B1 | 2/2001 | Kanter | 229/242 |
| 6,371,365 | B1 * | 4/2002 | Doucette et al. | 229/240 |
| 6,932,265 | B2 | 8/2005 | Sax et al. | 229/122 |
| 7,080,736 | B2 | 7/2006 | Jackson et al. | 206/738 |
| 7,992,716 | B2 | 8/2011 | Jackson | 206/738 |
| 2003/0146130 | A1 * | 8/2003 | Kanter et al. | 206/774 |
| 2003/0226783 | A1 * | 12/2003 | Jackson et al. | 206/772 |
| 2005/0263434 | A1 * | 12/2005 | Tibbels | 206/736 |
| 2006/0060643 | A1 | 3/2006 | Sheffer | 229/242 |
| 2006/0124507 | A1 * | 6/2006 | Kanter et al. | 206/774 |
| 2007/0257096 | A1 * | 11/2007 | Coltri-Johnson | 229/242 |
| 2008/0245850 | A1 * | 10/2008 | Spivey | 229/240 |

* cited by examiner

*Primary Examiner* — Gary Elkins
(74) *Attorney, Agent, or Firm* — Nixon Peabody LLP

(57) ABSTRACT

A container includes a first blank and a second blank. The first blank includes a first plurality of panel and a plurality flaps. The first plurality of panels includes a first side panel, a second side panel opposing the first side panel, a back panel, and a front panel of the container, the first plurality of flaps defines a bottom of the container and a first exterior portion of a top of the container. The front panel includes a first breakaway portion. The second blank includes an insert front panel and a top flap. The top flap defines a second exterior portion of the top of the container. The insert front panel includes a second breakaway portion that is attached to the first breakaway portion of the front panel.

15 Claims, 10 Drawing Sheets

DISPLAYABLE SHIPPING CONTAINER

CROSS-REFERENCE TO RELATED APPLICATIONS

This application claims the benefit of and priority to U.S. Provisional Patent Application No. 61/596,910, titled "Displayable Shipping Container" and filed on Feb. 9, 2012, which is incorporated herein by reference in its respective entirety.

FIELD OF THE INVENTION

The present invention relates generally to containers. In particular, the present invention relates to displayable shipping containers having superior compression features.

BACKGROUND

Flat sheets of corrugated paperboard, typically referred to as blanks, have been used for many years as the starting material to form containers. Corrugated paperboard generally refers to a multi-layer sheet material comprised of two sheets of liner bonded to a central corrugated layer of medium. Given a basic size requirement specified by the customer, industry standards, and the preference for low cost, paperboard container manufacturers strive to provide structural stacking strength with a minimal amount of corrugated paperboard.

In shipping and displaying products, particularly in a retail setting, it is desirable to have a container which is easy to pack, sturdy and fully enclosed for protection of contents during storage and shipping, and also suitable for display at a retail site. For example, it is beneficial to have a container which allows a customer at a retail site to easily reach into the container and remove products for purchase. Of course, the access opening through which a consumer can access the products must also be closed during shipment and storage to prevent spilling of the product out of the container. This has resulted in the development of a variety of containers which are configured to be convertible from a shipping configuration to a display configuration, which permits the converted container to be placed directly upon a shelf, or floor display, without having to remove the individual product items from the container. Typically, this is accomplished by providing the container with removable portions of the container that create apertures through which customers may then help themselves to the products within the converted container.

Such convertible containers represent a challenge in that they must be readily convertible into a form presentable to customers, while at the same time maintaining certain shipping performance characteristics, suitable for the shipment of non-self-supporting or even fragile products. Prior attempts at providing a displayable shipping container may suffer from a number of disadvantages. For example, prior displayable shipping containers often are either lacking in the necessary shipping performance characteristics or, in order to provide such performance, have structural elements that remain in position after converting to a display configuration that make access to the product inconvenient. Other displayable shipping containers are labor intensive to manufacture, assemble, or convert. And still other containers require excessive materials or, in some cases, extraneous components (e.g., a tie or a wrap) to secure a lid on a body of the container. Once converted to a display configuration, many displayable shipping containers often also include rough, unfinished, jagged, and uneven surfaces that are somewhat unsightly and do not provide the appeal of a neat, clean and presentable display.

Therefore, it would be desirable to have a container that addresses many, if not all, of these disadvantages.

SUMMARY

According to aspects of the present disclosure, a displayable shipping container includes a first blank and a second blank. The first blank includes a first plurality of panels and a first plurality of flaps integrally formed from a first sheet of material. The first plurality of panels include a first side panel, a second side panel opposing the first side panel, a back panel, and a front panel of the container. The first plurality of flaps define a bottom of the container and a first exterior portion of a top of the container. The front panel includes a first breakaway portion. The second blank includes an insert front panel and a top flap integrally formed from a second sheet of material. The top flap defines a second exterior portion of the top of the container. The insert front panel includes a second breakaway portion. The second breakaway portion of the insert front panel is attached to an interior the first breakaway portion of the front panel.

According to other aspects of the present disclosure, a displayable shipping container includes a bottom and a top opposing the bottom. The container further includes a first side panel, a second side panel, a back panel bridging the top and the bottom. The container further includes an inner front panel and an outer front panel. The inner front panel includes a removable first breakaway portion connected to at least a portion of the top. The outer front panel includes a removable second breakaway portion. The second breakaway portion is aligned with and attached to the first breakaway portion. The first breakaway portion has a first dimension and the second breakaway portion has a second dimension. The second dimension is greater than the first dimension.

According to further aspects of the present disclosure, a displayable shipping container includes a bottom and a top opposing the bottom. The container further includes a first side panel, a second side panel, and a back panel bridging the top and the bottom. The container also includes an inner front panel having a removable breakaway portion and an outer front panel having a first window opening therein. The window opening of the outer front panel is aligned with the removable window portion of the inner front panel. The container further includes a first flange panel configured to assist in forming a generally triangular shaped structure in a first interior corner of the container.

The above summary is not intended to represent each embodiment or every aspect of the present invention. Additional features and benefits of the present invention are apparent from the detailed description and figures set forth below.

BRIEF DESCRIPTION OF THE DRAWINGS

Other advantages of the invention will become apparent upon reading the following detailed description and upon reference to the drawings in which.

Figure 1:
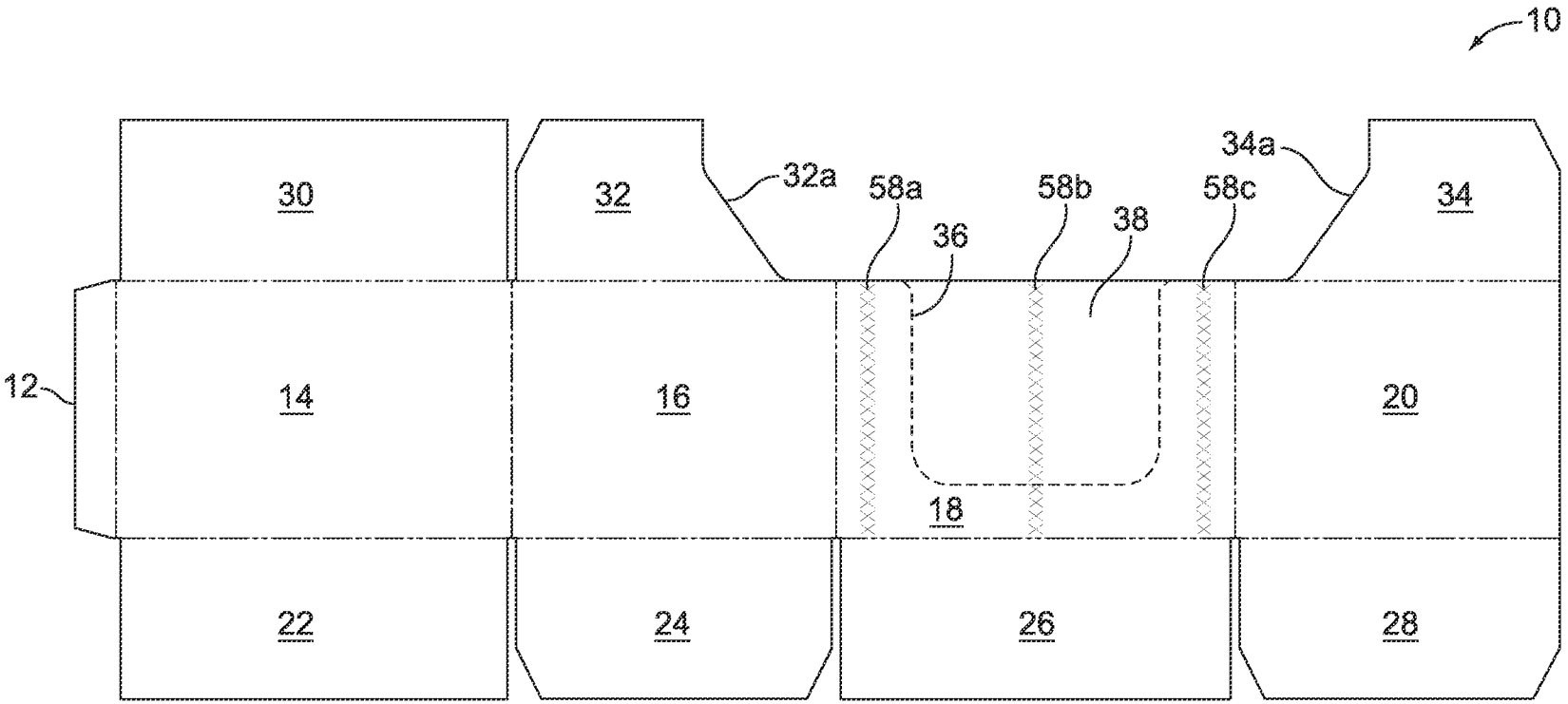
FIG. 1 is a top plan view of a blank for forming an enclosure portion of a container according to one embodiment of the present disclosure.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION

FIG. 1 illustrates a top plan view of a blank 10 for an enclosure portion of a container according to one embodiment of the present disclosure (also referred to as an "enclosure blank"). The enclosure blank 10 includes an overlap panel 12, a back panel 14, a first side panel 16, a front panel 18, and a second side panel 20. Adjacent panels 12, 14, 16, 18, 20 are connected with one another by substantially parallel fold lines. The overlap panel 12 is configured to be attached to the second side panel 20, as described in further detail below.

The enclosure blank 10 further includes a first major bottom flap 22, a first minor bottom flap 24, a second major bottom flap 26, and a second minor bottom flap 28 hingedly connected to the back panel 14, the first side panel 16, the front panel 18, and the second side panel 20, respectively, by fold lines. The enclosure blank 10 also includes a first major top flap 30, a first minor top flap 32, and a second minor top flap 34 hingedly connected to the back panel 14, the first side panel 16, and the second side panel 20, respectively, by fold lines. The first minor top flap 32 includes a first recessed lateral surface 32*a* and the second minor top flap 34 includes a second recessed lateral surface 34*a*, which will be described in further detail below.

The front panel 18 of the enclosure blank 10 includes a line of weakness 36 that defines a removable first breakaway portion 38. The first breakaway portion 38 is separable and removable from the remainder of the enclosure blank 10 via the line of weakness 36. It is contemplated that the first breakaway portion 38 is not limited to the particular shape and configuration illustrated in FIG. 1. Rather, the first breakaway portion 38 can be formed in other shapes, sizes, and/or locations on the front panel 18.

Figure 2:
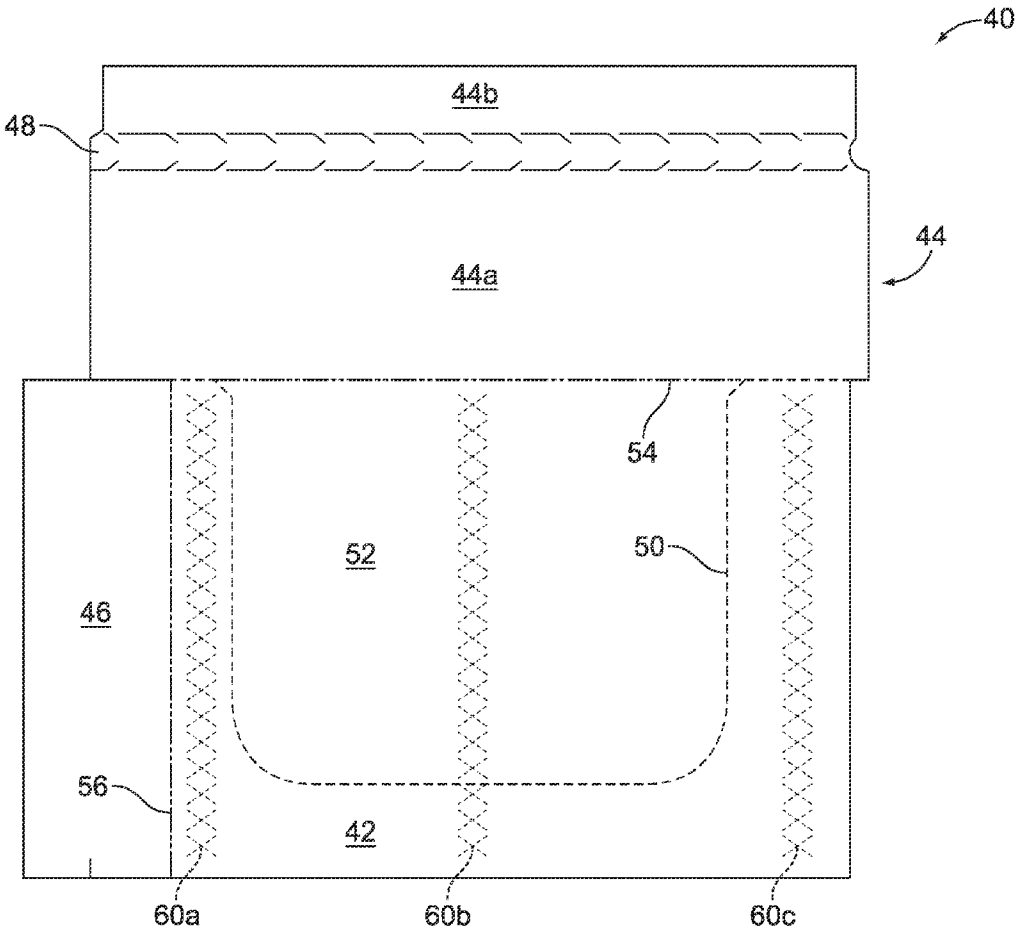
FIG. 2 is a top plan view of a blank for forming an insert portion of a container according to one embodiment of the present disclosure.

Turning now to FIG. 2, a top plan view of a blank 40 for an insert portion of the container (also referred to as an "insert blank"). The insert blank 40 includes an insert front panel 42, an insert top flap 44, and a flange panel 46. The insert top flap 44 includes a separation element 48 disposed between a first portion 44*a* of the insert top flap 44 and a second portion 44*b* of the insert top flap 44. The separation element 48 is configured to permit separation and removal of first portion 44*a* from the second portion 44*b*. In the illustrated embodiment, the separation element 48 comprises a zipper rule; however, it is contemplated that the separation element can comprise any suitable feature for separating and removing the first portion 44*a* of the insert top flap 44 from the second portion 44*b* of the insert top flap 44 (e.g., a perforation line, a tear-strip, etc.).

The insert front panel 42 includes a line of weakness 50 that defines a second removable breakaway portion 52. The second breakaway portion 52 is hingedly connected to the first portion 44*a* of the insert top flap 44 by a fold line 54. In FIG. 2, the line of weakness 50 extends laterally at the interface between the insert front panel 42 and the insert top flap 44 (i.e., the fold line 54); however, it is contemplated that the insert front panel 42 can be connected to laterally of the insert top flap 44 laterally to the fold line 54. When the insert front panel 42 is connected to the insert top flap 44 by a line of weakness, light nicking, or light scoring on the lateral sides of the fold line 54, the container is more fully closed and has improved stacking strength when in a shipping configuration, as described further below. Alternatively, it is contemplated that the insert front panel 42 can be cut or otherwise separated from the insert top flap 44 on one or both sides of the interface between the second breakaway portion 52 and the insert top flap 44. As will be described in further detail below, the second breakaway portion 52 can have dimensions that are greater than the dimensions of the first breakaway portion 38. The flange panel 46 is hingedly connected to a lateral side of the insert front panel 42 by a fold line 56. The flange panel 46 is separated from the insert top flap 44 by, for example, a cut or other means of separation so as to permit the flange panel 46 to be folded about the fold line 56. It is contemplated that according to some alternative aspects of the present disclosure, the fold line 56 can be scored or perforated to facilitate easier folding about the fold line 56.

In one non-limiting example, the overlap panel 12, the back panel 14, the first side panel 16, the front panel 18, and the second side panel 20 can have a height of approximately 100 millimeters (i.e., approximately 4 inches) to approximately 400 millimeters (i.e., approximately 16 inches). The overlap panel 12 can have a width of approximately 20 millimeters (i.e., approximately 1 inch) to approximately 65 millimeters (i.e., approximately 3 inches). The back panel 14 and the front panel 18 can have a width of approximately 200 millimeters (i.e., approximately 8 inches) to approximately 600 millimeters (i.e., approximately 24 inches). The first side panel 16 and the second side panel 20 can have a width of approximately 150 millimeters (i.e., approximately 6 inches) to approximately 500 millimeters (i.e., approximately 20 inches). The first major bottom flap 22, the first minor bottom flap 24, the second major bottom flap 26, the second minor bottom flap 28, the first major top flap 30, the first minor top flap 32, and the second minor top flap can have a length of approximately 75 millimeters (i.e., approximately 3 inches) to approximately 250 millimeters (i.e., approximately 10 inches) and widths that generally correspond to the widths of the respective panels 14, 16, 18, 20 to which the flaps 22, 24, 26, 28, 30, 32, 34 are connected. The line of weakness 36 can be located approximately 35 millimeters (i.e., approximately 1 inch) to approximately 125 millimeters (i.e., approximately 5 inches) from the fold line connecting the front panel 18 and the first side panel 16, approximately 35 millimeters (i.e., approximately 1 inch) to approximately 125 millimeters (i.e., approximately 5 inches) from the fold line connecting the front panel 18 and the second side panel 16, and approximately 25 millimeters (i.e., approximately 1 inch) to approximately 100 millimeters (i.e., approximately 4 inches) from the fold line connecting the front panel 18 and the second major bottom flap 26. The insert front panel 42 and the flange panel 46 can have a height of approximately 100 millimeters (i.e., approximately 4 inches) to approximately 400 millimeters (i.e., approximately 16 inches). The flange panel can have a width of approximately 30 millimeters (i.e., approximately 1 inch) to approximately 125 millimeters (i.e., approximately 5 inches). The insert front panel can have a width of approximately 150 millimeters (i.e., approximately 6 inches) to approximately 600 millimeters (i.e., approximately 24 inches).

In another non-limiting example, the enclosure blank 10 can include the following dimensions. The overlap panel 12, the back panel 14, the first side panel 16, the front panel 18, and the second side panel 20 can have a height of approximately 260 millimeters (i.e., approximately 10.25 inches). The overlap panel 12 can have a width of approximately 42 millimeters (i.e., approximately 1.63 inches). The back panel 14 and the front panel 18 can have a width of approximately 400 millimeters (i.e., approximately 15.75 inches). The first side panel 16 and the second side panel 20 can have a width of approximately 327 millimeters (i.e., approximately 12.88 inches). The first major bottom flap 22, the first minor bottom flap 24, the second major bottom flap 26, the second minor bottom flap 28, the first major top flap 30, the first minor top flap 32, and the second minor top flap can have a length of approximately 162 millimeters (i.e., approximately 6.38 inches) and widths that generally correspond to the widths of the respective panels 14, 16, 18, 20 to which the flaps 22, 24, 26, 28, 30, 32, 34 are connected. The line of weakness 36 can be located approximately 76 millimeters (i.e., approximately 3 inches) from the fold line connecting the front panel 18 and the first side panel 16, approximately 76 millimeters (i.e., approximately 3 inches) from the fold line connecting the front panel 18 and the second side panel 16, and approximately 54 millimeters (i.e., approximately 2.13 inches) from the fold line connecting the front panel 18 and the second major bottom flap 26.

In the same non-limiting example, the insert blank 40 can include the following dimensions. The insert front panel 42 and the flange panel 46 can have a height of approximately 257 millimeters (i.e., approximately 10.13 inches). The flange panel can have a width of approximately 76 millimeters (i.e., approximately 3 inches). The insert front panel can have a width of approximately 365 millimeters (i.e., approximately 14.38 inches).

It is contemplated that the dimensions of the enclosure blank 10 and the insert blank 40 can be designed to have other dimensions and/or relative size proportions. For example, although the front panel 18 is illustrated and described as having greater dimensions than the first side panel 16, it is contemplated that the first side panel 16 can have dimensions that are greater than the dimensions of the front panel 18. As another example, the first side panel 16 may have different dimensions than the second side panel 20, or the first minor bottom flap 24 may have different dimensions than the second minor bottom flap 26. Additionally, it is contemplated that the relative dimensions of the various panels and/or flaps can take into account the spacing requirements for providing separation or gaps between the flaps, and/or the thickness of the overlap panel 12 that is attached to the second side panel 20.

The assembly of the enclosure blank 10 and the insert blank 40 to form the displayable shipping container 100 (see FIG. 3) will now be described. First, the insert front panel 42 of the insert blank 40 is attached to the front panel 18 of the enclosure blank 10. In the embodiment illustrated in FIGS. 1-2, the insert front panel 42 is attached to the front panel 18 by applying an adhesive generally at or near one or more adhesive areas 58*a-c* of the enclosure blank 10 and/or one or more adhesive areas 60*a-c* of the insert blank 40. As such, it is contemplated that the adhesive(s) can be applied to the adhesive areas 58*a-c* of the enclosure blank 10, the adhesive areas 60*a-c* of the insert blank 40, or both to attach the insert front panel 42 to the front panel 18.

With the insert front panel 42 attached to the front panel 18, the adhesive area 58*a* of the enclosure blank 10 is aligned with the adhesive area 60*a* of the insert blank 40, the adhesive area 58*b* of the enclosure blank 10 is aligned with the adhesive area 60*b* of the insert blank 40, and the adhesive area 58*c* of the enclosure blank 10 is aligned with the adhesive area 60*c* of the insert blank 40. Accordingly, with the insert front panel 42 attached to the front panel 18, the first breakaway portion 38 is aligned with and attached to the second breakaway portion 52. As described in further detail below, attaching the first breakaway portion 38 to the second breakaway portion 52 facilitates removal of the first breakaway portion 38 during conversion from a shipping configuration of the container 100 to a display configuration. Attaching the insert front panel 42 to the front panel 18 on the lateral sides (e.g., at or near 58*a,c* and 60*a,c*) also facilitates removal of both the first breakaway portion 38 and the second breakaway portion 52 during conversion, as described below. However, it is contemplated that according to alternative aspects, the adhesive areas 58*a-c*, 60*a-c* can be provided in different positions and sizes and/or there can be more or fewer adhesive areas 58*a-c*, 60*a-c* provided than those illustrated.

Figure 3:
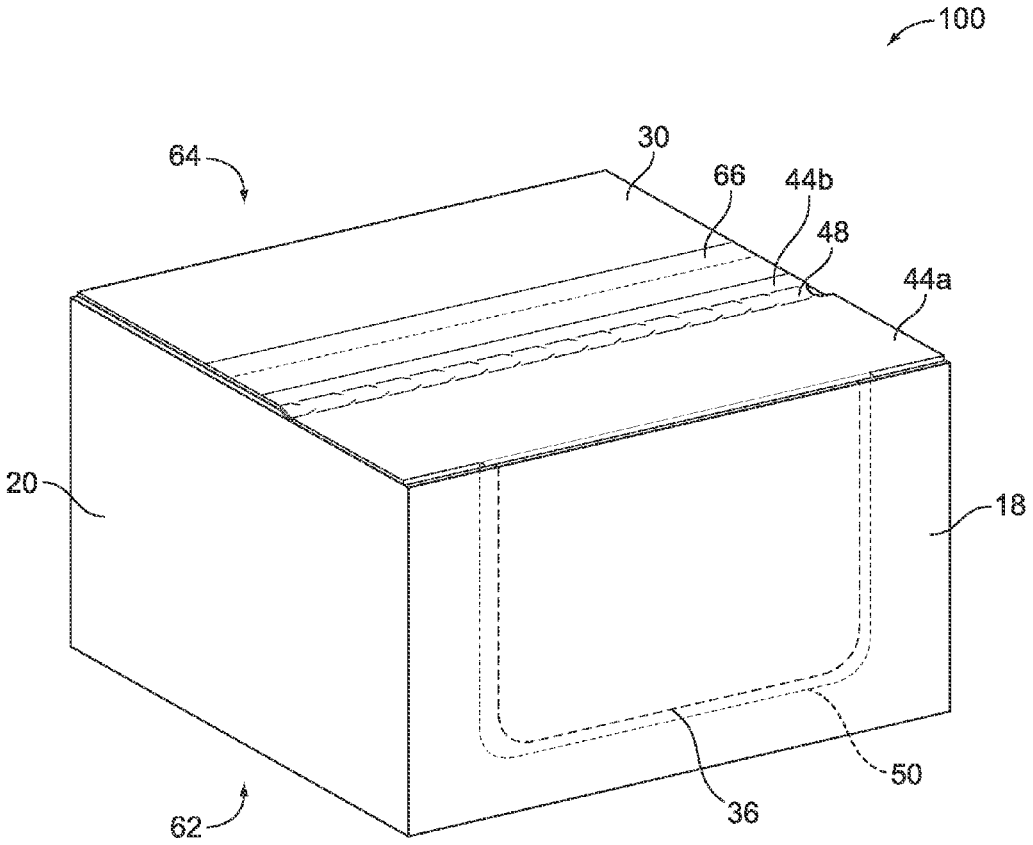
FIG. 3 is a perspective view of the container formed from the blanks of FIGS. 1-2 in a shipping configuration.

The enclosure blank 10 and the attached insert blank 40 can then be erected to form the assembled container 100 in a shipping configuration as shown in FIG. 3. First, the overlap panel 12 is attached to the second side panel 20 by, for example, a suitable adhesive(s). Next, the first minor bottom flap 24 and the second minor bottom flap 28, followed by the first major bottom flap 22 and the second major bottom flap 26, are folded inward (i.e., towards the space formed by the panels 14, 16, 18, 20) and sealed (e.g., by tape, staples, adhesives, combinations thereof, and/or the like) to form a bottom 62 of the container 100. The container 100 can then be optionally filled with products through the top opening of the container 100. Then the first minor top flap 32 and the second minor top flap 34, followed by the first major top flap 30 and the insert top flap 44, are folded inwards and sealed (e.g., by tape, staples, adhesives, combinations thereof, and/or the like) to form a top 64 of the container 100.

The sealing of the first major top flap 30 and the insert top flap 44 can be configured so not to prevent or inhibit separation and removal of the first portion 44*a* of the insert top flap 44 from the second portion 44*b* of the insert top flap 44 when the container 100 is later converted to a display configuration. For example, in the embodiment illustrated in FIG. 3, the first major top flap 30 and the insert top flap 44 are sealed by a piece of tape 66 such that the tape 66 is located over the first major top flap 30 and the second portion 44*b* of the insert top flap 44 but not over the separation element 48 and the first portion 44*a* of the insert top flap 44.

It is contemplated that the assembly of the container 100 described above can be achieved with or without the assistance of a case erector. Additionally, it is contemplated that some of these steps can be performed in a different order than is described above. For example, the top 64 of the container 100 can be formed before forming the bottom 62 of the container 100 or the insert blank 40 can be attached to the enclosure blank 10 after the overlap panel 12 is attached to the second side panel 20.

As described above, FIG. 3 shows the container 100 in a shipping configuration. In the shipping configuration, the container 100 provides a closed enclosure that prevents loss of product and product damage during shipping. The interior space of this closed enclosure is defined by the top 64, the bottom 62, the back panel 14, the first side panel 16, the second side panel 20, and the front panel 18 and attached insert front panel 42.

Advantageously, the container 100 includes several features that provide improved structural integrity and stacking strength (also known as "compression strength") characteristics. One such feature is provided by the flange panel 46 of the insert blank 40. In particular, the flange panel 46 is configured such that, as the container 100 is assembled, the second side panel 20 engages the flange panel 46, forcing the flange panel 46 to rotate about the fold line 56. The result is a generally triangular support structure 70 (see FIG. 4B) in an interior corner of the container 100 defined by the flange panel 46, the first side panel 16, and the front panel 18. This generally triangular support structure 70 provides improved structural integrity and stacking strength to the container 100. For example, in some instances, the stacking strength is improved by more than ten percent relative to similar containers that omit the generally triangular support structure 70.

Another feature providing improved structural integrity and stacking strength is the configuration of the front panel 18 and the insert front panel 42. As described above, the second breakaway portion 52 is aligned with and attached to the first breakaway portion 38, effectively increasing the thickness of the front of the container 100. Due to the increased material thickness, stacking strength is improved and the breakaway portions 38, 52 are more resistant to inadvertent perforations of the lines of weakness 36, 50. Moreover, when the second breakaway portion 52 has dimensions that are greater than the dimensions of the first breakaway portion 38, the resistance to inadvertent perforation of lines of weakness 36, 50, the structural integrity, and the stacking strength of the container 100 are further improved at the first breakaway portion 38 and the second breakaway portion 52.

Additionally, the first minor top flap 32 and the second minor top flap 34 can be configured to mitigate the risk that the separation element 48 will become inadvertently perforated, removed, or otherwise compromised during shipping. For example, the first minor top flap 32 and the second minor top flap 34 can be configured to at least partially extend beneath and support the first portion 44*a*, the separation element 48, and the second portion 44*b*. However, as described below, the container 100 is also configured to provide access to products through an opening in the top of the container 100 when in a display configuration. Accordingly, the first recessed lateral surface 32*a* of the first minor top flap 32 and the second recessed lateral surface 34*a* of the second minor top flap 34 extend beneath and support the first portion 44*a*, the separation element 48, and the second portion 44*b* so as to mitigate these risks while also providing access to products within the container 100 when in a display configuration.

Significantly, because of the increased stacking strength that is achieved by the features of the container 100, lighter materials can be used, which in turn results in reduced material usage and lower cost of manufacture (even compared to one-piece displayable shipping containers).

Figure 4A:
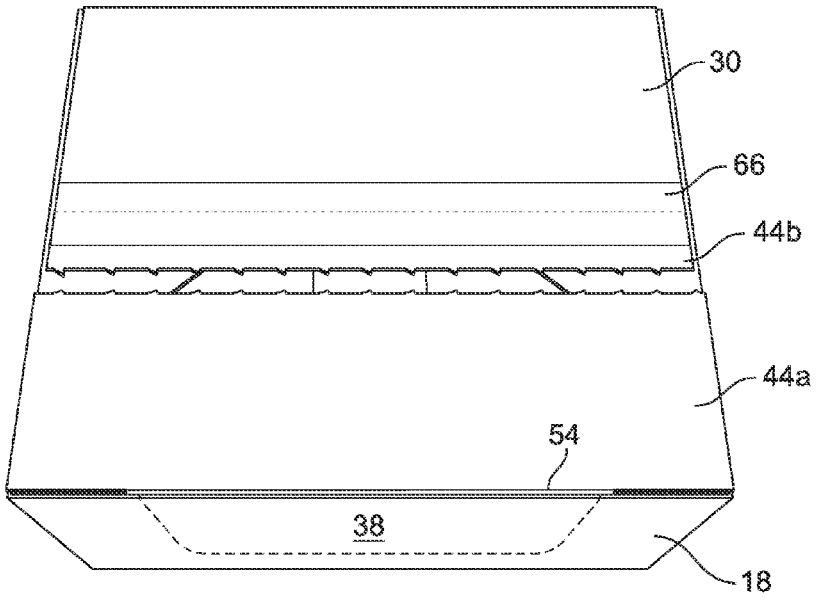
FIGS. 4A-C are a top views of the container formed from the blanks of FIGS. 1-2 as the container is being converted from a shipping configuration to a display configuration.
Figure 4B:
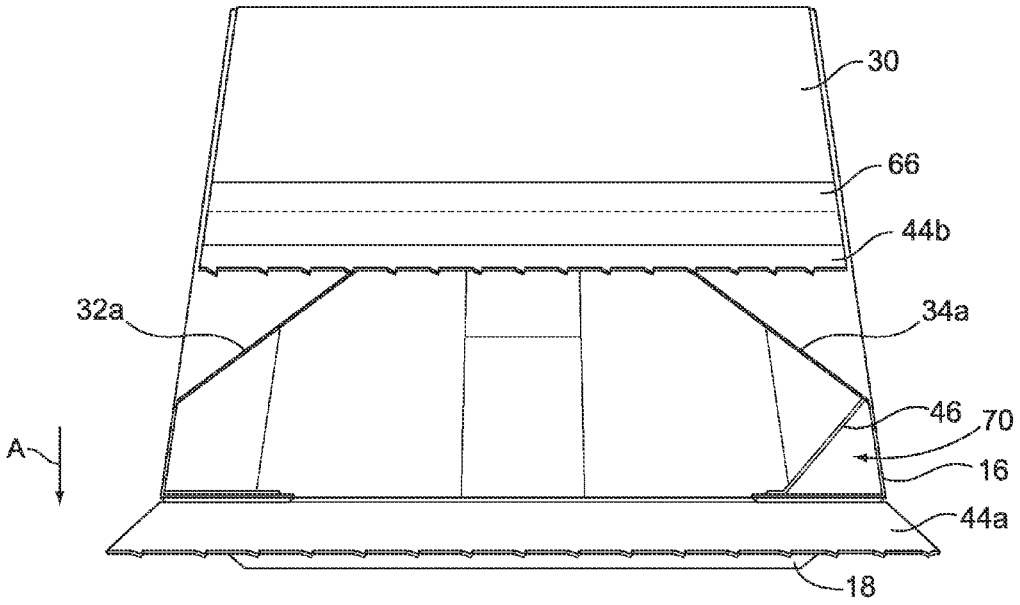
Figure 4C:
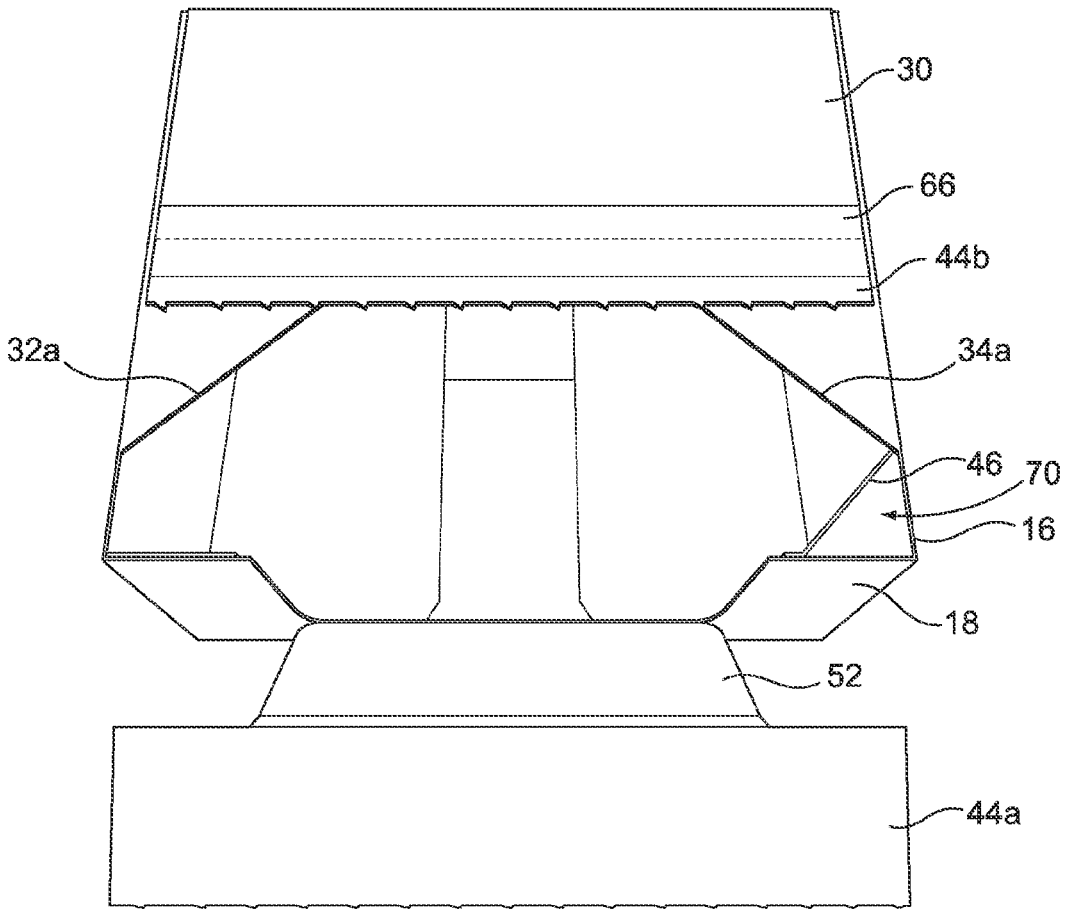

After shipping the container 100 to a retail site, the container 100 can be converted from the shipping configuration (FIG. 3) to a display configuration (FIG. 5) by removing the first portion 44*a* of the insert top flap 44, the first breakaway portion 38, and the second breakaway portion 52. The following are exemplary steps for converting the container 100 from a shipping configuration to a display configuration as illustrated in FIGS. 4A-C. First, the first portion 44*a* of the insert top flap 44 is separated from the second portion 44*b* of the insert top flap 44*b* such as, for example, by tearing out a zipper rule separation element 48. FIG. 4A shows a top view of the container 100 after the separation element 48 has been removed to separate the first portion 44*a* from the second portion 44*b*. Because the tape 66 (or other sealing means) is disposed over the second portion 44*b* of the insert top flap 44 but not the first portion 44*a* of the insert top flap 44, the first portion 44*a* can be rotationally moved about the fold line 54 to the position shown in FIG. 4B. The second portion 44*b* remains attached to the first major top flap 30 by the tape 66.

From the position shown in FIG. 4B, the first portion 44*a* can be pulled outwardly relative to the front panel 18 (e.g., generally in the direction of the illustrated arrow A) to separate the first breakaway portion 38 from the front panel 18 along the weakness line 36 and the second breakaway portion 52 from the insert front panel 42 along the weakness line 50 as shown in FIG. 4C. This can be accomplished because the first portion 44*a* is connected to the second breakaway portion 52 via the fold line 54 and the second breakaway portion 52 is attached (e.g., by adhesive(s)) to the first breakaway portion 38. Also, because the insert front panel 42 is attached to the front panel 18 laterally of the breakaway portions 38, 52, the insert front panel 42 remains attached to the front panel 18, which assists in separating the second breakaway portion 52 from the insert front panel 42. Advantageously, the likelihood of the first breakaway portion 38 separating from the second breakaway portion 52 due to the force applied in a generally in-to-out direction (i.e., generally along arrow A) is substantially mitigated because the first portion 44*a* is connected to the second breakaway portion 52 as opposed to the first breakaway portion 38.

Figure 5:
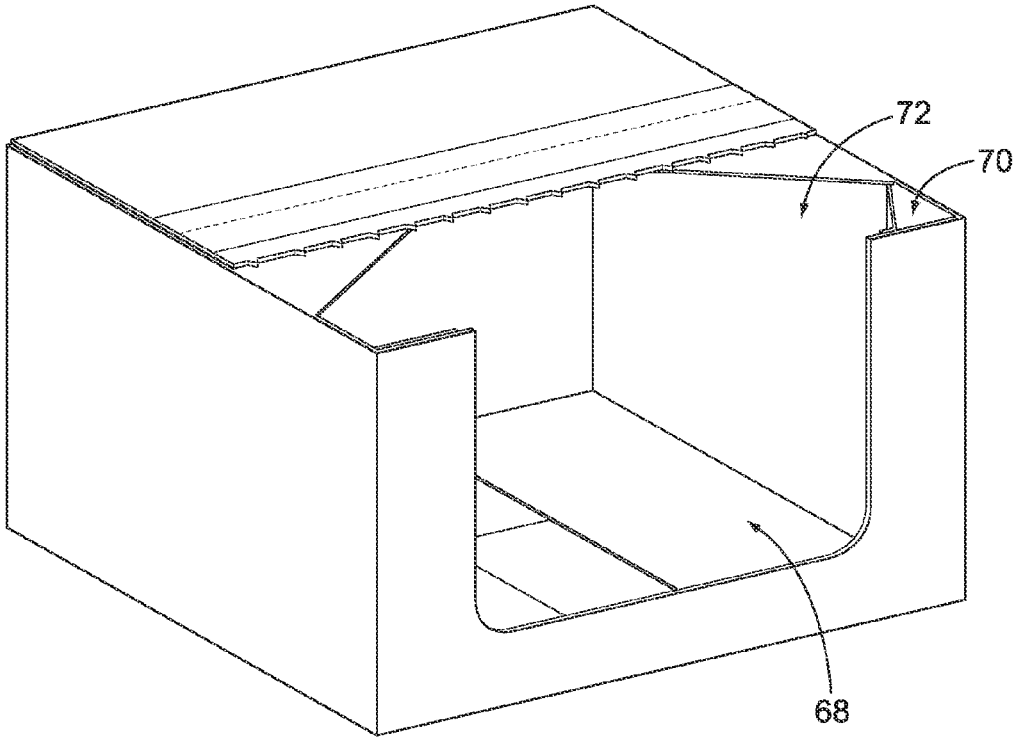
FIG. 5 is a perspective view of the container formed from the blanks of FIGS. 1-2 in a display configuration.

The first portion 44*a*, the first breakaway portion 38, and the second breakaway portion 52 can then be completely removed from the container 100 by continuing to pull the first portion 44*a* in the outwardly direction relative to the front panel 18. A perspective view of the container 100 in the display configuration with the first portion 44*a*, the first breakaway portion 38, and the second breakaway portion 52 separated and removed is illustrated in FIG. 5. As shown in FIG. 5, the container 100 in the display configuration includes a window opening 68 formed in the front panel 18 and the insert front panel 42 where the first breakaway portion 38 and the second breakaway portion 52 were removed. The window opening 68 provides access to the products within the container 100. Advantageously, when the dimensions of the second breakaway portion 52 are greater than the dimensions of the first breakaway portion 38, the edges of the insert front panel 42 are generally obscured by the front panel 18. This mitigates unsightly, uneven edges for the window opening 68 and provides a container 100 in the display configuration with a neat, clean, and presentable display.

Additionally, with the container 100 in the display configuration, products within the container 100 can also be accessed from above the container 100 through a top opening 72. The top opening 72 is formed by the recessed surfaces 32*a*, 34*a* of the first minor top flap 32 and the second minor top flap 34 when the first portion 44*a* of the insert top flap 44 is removed. As described above, the recessed surfaces 32*a*, 34*a* are configured so as to provide support to the first portion 44*a*, the separation element 48, and the second portion 44*b* when the container 100 is in the shipping configuration and to provide the top opening 72 to access products when the container 100 is in the display configuration.

The top opening 72 formed by the recessed surfaces 32*a*, 34*a* also highlights another advantageous aspect provided by the generally triangular shaped structure 70. In particular, the generally triangular shaped structure 70 improves stackability by providing a surface that can support and better distribute the weight of a second container stacked above the container 100 when the container 10 is in the display configuration.

It is contemplated that the container 100 may include advertising features, descriptions, graphics, or other information. Further, it is contemplated that the exterior surface of the first breakaway portion 38 can itself be printed with graphics or text for use during shipment—for example, shipping instructions or information about placement of the item within a store—which are removed along with the first breakaway portion 38 for display of the container 100. In other words, the first breakaway portion 38 can be provided with distribution information thereon, which is unimportant to an end user such as a retail customer and is easily removed for display of the container.

Figure 6A:
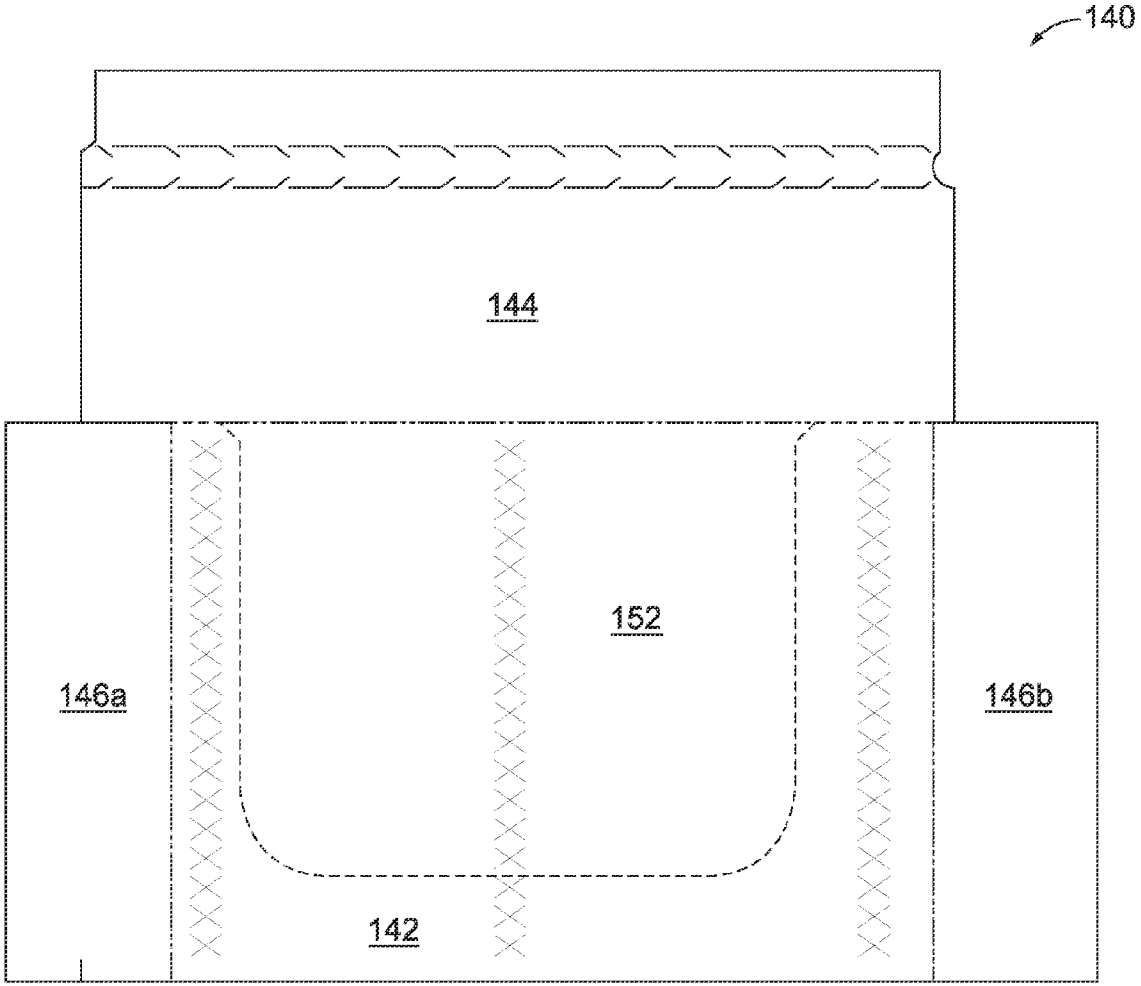
FIG. 6A is a top plan view of a blank for forming an insert portion of a container according to another embodiment of the present disclosure
Figure 6B:
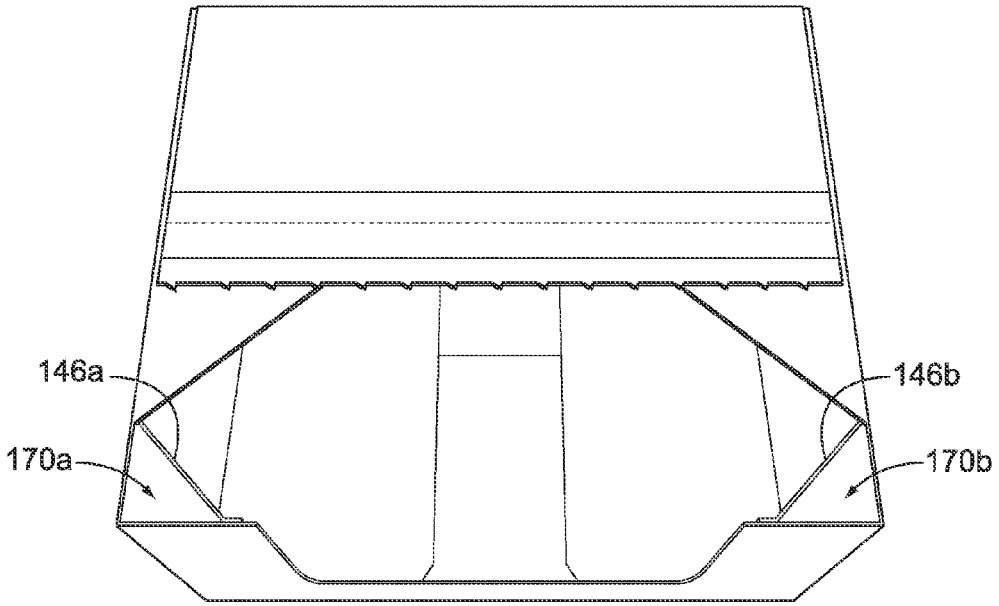
FIG. 6B is a top view of a container formed from the blanks of FIG. 1 and FIG. 6A in a display configuration.

Referring now to FIG. 6A, an insert blank 140 according to an alternative embodiment is illustrated. The insert blank 140 is substantially similar to the insert blank 40 described above, except the insert blank 140 includes an additional flange panel. Accordingly, the insert blank 140 includes an insert front panel 142, an insert top flap 144, a first flange panel 146*a*, a second flange panel 146*b*, and a second breakaway portion 152. When insert blank 140 is assembled with the enclosure blank 10 as described above, the resulting container includes two generally triangular shaped structures 170*a*, 170*b* as shown in FIG. 6B. The two generally triangular shaped structures 170*a*, 170*b* provide even greater structural integrity and stacking strength as compared to a container having zero or one generally triangular shaped structure.

Figure 7A:
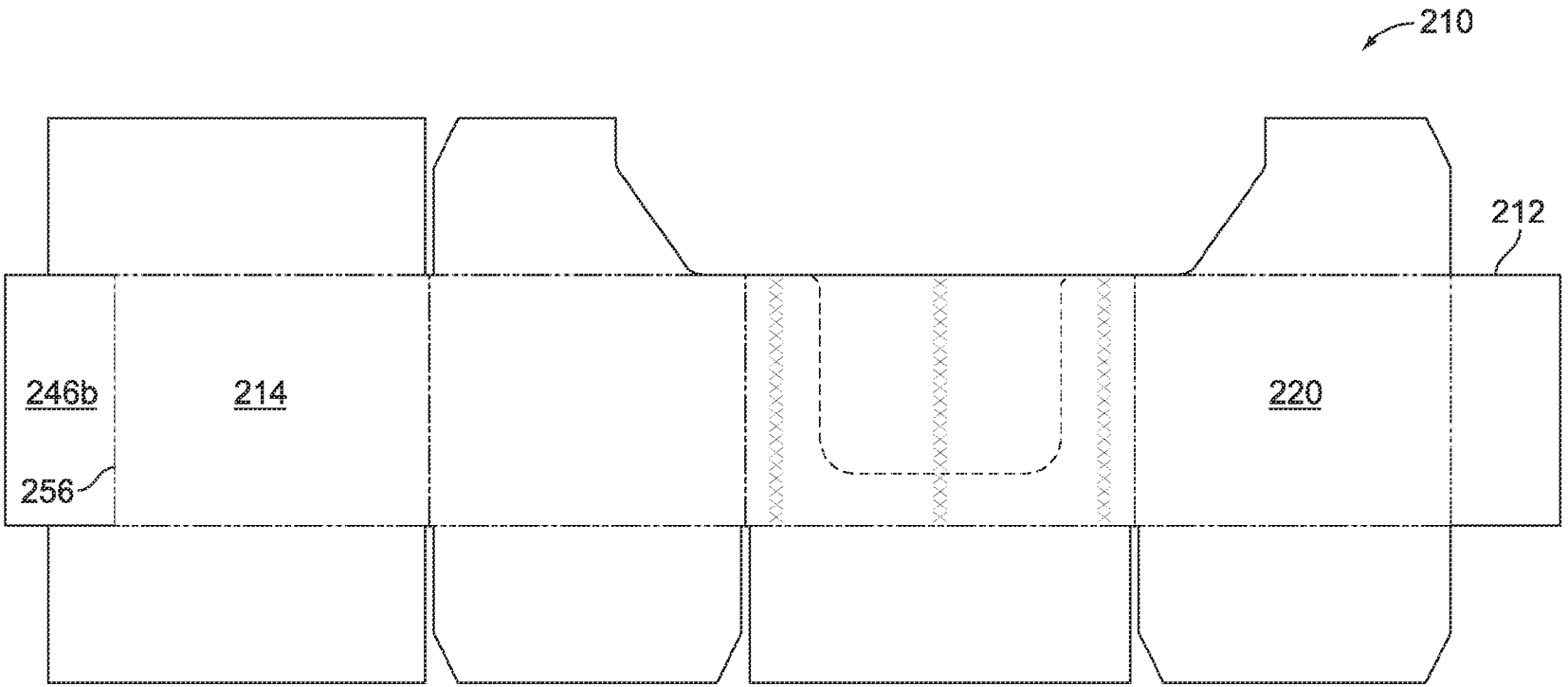
FIG. 7A is a top plan view of a blank for forming an enclosure portion of a container according to another embodiment of the present disclosure
Figure 7B:
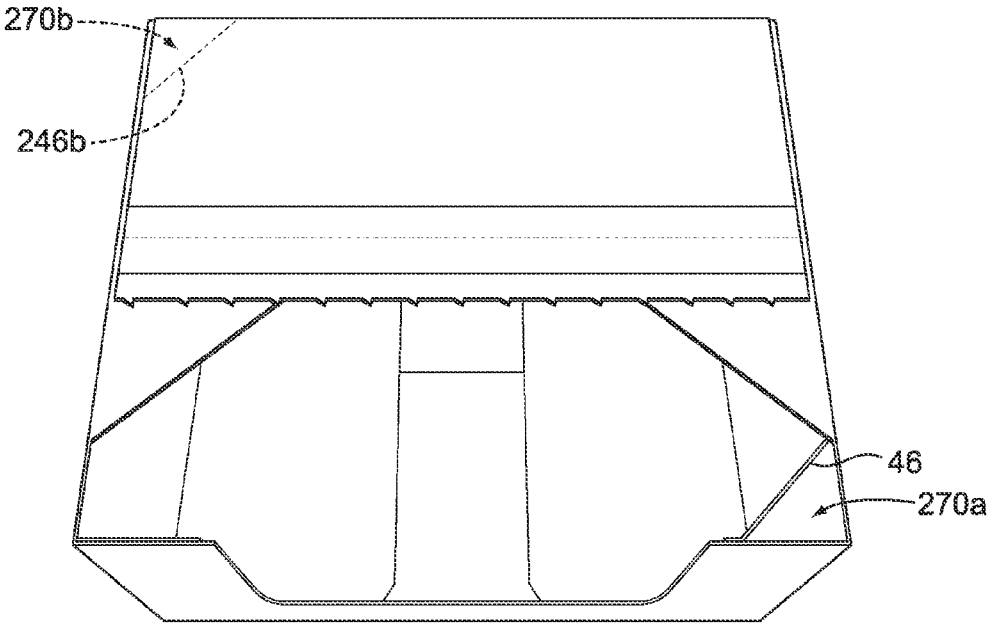
FIG. 7B is a top view of a container formed from the blanks of FIG. 2 and FIG. 7A in a display configuration.

Referring now to FIG. 7A, an enclosure blank 210 according to an alternative embodiment is illustrated. The enclosure blank 210 is substantially similar to the enclosure blank 10 described above, except the enclosure blank 210 includes an overlap panel 212 connected to a second side panel 220 instead of a back panel 214, and the enclosure blank 210 includes a second flange panel 246*b* connected to the back panel 214 by a fold line 256 (e.g., in a similar manner to the way the flange panel 46 is connected to the insert front panel 42 in FIG. 2). The enclosure blank 210 and the insert blank 40 are assembled as described above, except the overlap panel 212 is attached to an exterior surface of the back panel 214. The resulting container includes two generally triangular shaped structures 270*a*, 270*b* in opposing (i.e., kiddie-corner) interior corners of the container as shown in FIG. 7B.

It is contemplated that the generally triangular shaped structures can also be formed by attaching a separate flange panel (i.e., a flange panel that is not integral with either an enclosure blank or an insert blank) to the panels that form an interior corner of a container. It is further contemplated that a container can include one or more generally triangular shaped structures in adjacent or opposing interior corners of the container by any combination of flange panels separate from or integral with the enclosure blank and/or the insert blank. It is still further contemplated that according to some alternative embodiments, a container formed from the enclosure blanks and insert blanks disclosed herein may include no flange panel and, thus, no generally triangular shaped structures.

Additionally, it is contemplated that according to some alternative embodiments, the first breakaway portion 38 of the front panel 18 can be removed prior to assembly of the container 100. For example, the first breakaway portion 38 can be removed by perforating the line of weakness 36 or the first breakaway portion 38 can be diecut during manufacture of the enclosure blank 10. While such alternative embodiments may still provide a number of the benefits and advantages disclosed herein, it will be appreciated that some structural integrity and stacking strength characteristics will be sacrificed for a container that omits the first breakaway portion 38 in a shipping configuration.

While the second breakaway portion 52 is illustrated as having a shape that is similar to the shape of the first breakaway portion 38, it is contemplated that the second breakaway portion 52 can have a shape that is different from the shape of the first breakaway portion 38. Additionally, although the overlap panel has been illustrated and described as being attached to either a second side panel or a back panel, it will be appreciated that an overlap panel can be connected to a first side panel or a front panel in some embodiments.

The containers of the embodiments described herein are typically manufactured using corrugated paperboard, preferably with the corrugations running in a vertical direction for increased strength. As non-limiting examples, the container 100 is manufactured from C-flute, EB-flute, E-flute or B-flute corrugated paperboard. It is to be understood that the principles of this invention could be applied to containers made of other materials, such as non-corrugated paperboards, cardboard, corrugated fiberboard, non-corrugated fiberboard, solid-fiber board, polymeric materials, and other foldable materials.

While the containers of the embodiments described above include glue or adhesive for attaching various panels and flaps of the containers, it is contemplated that any other suitable method of joining or attaching panels and flaps may be utilized such as, for example, staples, tapes, a system of corresponding slits and tabs, combinations thereof, and/or the like.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A container comprising:

a first section including a first plurality of panels and a first plurality of flaps integrally formed from a first sheet of material, the first plurality of panels including a first side panel, a second side panel opposing the first side panel, a back panel, and a front panel of the container, the first plurality of flaps defining a bottom of the container and a first exterior portion of a top of the container, the front panel including a first breakaway portion; and a second section including an insert front panel and a top flap integrally formed from a second sheet of material, the top flap defining a second exterior portion of the top of the container, the insert front panel including a second breakaway portion, the second breakaway portion of the insert front panel being attached to an interior surface of the first breakaway portion of the front panel.

2. The container of claim 1, wherein the first breakaway portion has a first dimension and the second breakaway portion has a second dimension, the second dimension being greater than the first dimension.

3. The container of claim 1, wherein the second section further includes a first flange panel extending from the insert front panel to the first side panel to form a generally triangular structure defined by the front panel, the first side panel, and the first flange panel.

4. The container of claim 3, wherein the second section further includes a second flange panel extending from the insert front panel to the second side panel to form a generally triangular structure defined by the front panel, the second side panel, and the second flange panel.

5. The container of claim 1, wherein the first section further includes an overlap panel extending from one of the plurality of first panels, the overlap panel being attached to a different one of the plurality of first panels to form an enclosure of the container.

6. The container of claim 5, wherein the first section further includes a flange panel extending from the back panel to the one of the plurality of first panels, the flange panel being configured to form a generally triangular shaped structure defined by the back panel, the flange panel, and the one of the plurality of first panels.

7. The container of claim 1, wherein the top flap of the second section includes a first portion and a second portion, the first portion being between the insert front panel and the second portion, the first portion being separable from the second portion.

8. The container of claim 7, wherein the top flap includes a separation element between the first portion and the second portion of the top flap configured to separate the first portion of the top flap from the second portion of the top flap.

9. The container of claim 7, wherein the first plurality of flaps includes a first minor top flap and a second minor top flap, the first minor top flap and the second minor top flap having a recessed surface near the front panel for permitting access to the interior of the container when the first portion of the top flap is removed from the container.

10. The container of claim 9, wherein the first minor top flap and the second minor top flap are disposed below of and support the second portion of the top flap.

11. The container of claim 9, wherein the first minor top flap and the second minor top flap are configured to inhibit separation of the first portion of the top flap from the second portion of the top flap in response to a force applied to the top of the container.

12. The container of claim 7, wherein the first breakaway portion and the second breakaway portion are configured to be removed from the front panel and the insert front panel, respectively, by separating the first portion of the top flap from the second portion of the top flap and applying a force to the first portion of the top flap in a generally outwards direction relative to the front panel.

13. A container comprising:

a bottom;

a top opposing the bottom;

a first side panel, a second side panel, and a back panel bridging the top and the bottom;

an inner front panel including a removable breakaway portion;

an outer front panel including a first window opening therein, the window opening of the outer front panel being aligned with the removable window portion of the inner front panel; and a first flange panel configured to assist in forming a generally triangular shaped structure in a first interior corner of the container, wherein the bottom, the first side panel, the second side panel, the back panel, and the outer front panel are formed from a first section the inner front panel is formed from a second section, a first exterior portion of the top being formed from the first section and a second exterior portion of the top being formed from the second section.

14. The container of claim 13, wherein a second window opening is formed in the inner front panel when the removable breakaway panel is removed from the inner front panel, the first window opening of the outer front panel and the second window opening of the inner front panel being configured to permit access to an interior space of the container when the breakaway portion is removed from the inner front panel.

15. The container of claim 14, wherein a removable portion of the top of the container is connected to the breakaway portion of the inner front panel.

* * * * *